United States Patent [19]

Molnar et al.

[11] 4,344,660

[45] Aug. 17, 1982

[54] BASEBALL EQUIPMENT CABINET

[76] Inventors: Albert E. Molnar, Ringtown, Pa.; William J. Molnar, Phoenix, Ariz.

[21] Appl. No.: 159,786

[22] Filed: Jun. 16, 1980

[51] Int. Cl.[3] ..... A47B 81/00; A47F 7/00

[52] U.S. Cl. ..... 312/250; 312/42; 312/290; 312/324; 211/14; 211/49 R

[58] Field of Search ..... 312/250, 324, 290, 257 R, 312/257 SK, 257 SM, 257 A, 262, 272, 42; 211/49 R, 14

[56] References Cited

U.S. PATENT DOCUMENTS

| | | | |
|---|---|---|---|
| 251,337 | 12/1881 | Burrows | 312/324 |
| 1,212,522 | 1/1917 | Lonson | 211/49 R |
| 2,070,507 | 2/1937 | Bishop | 312/290 |
| 2,340,561 | 2/1944 | Renfro | 312/42 |
| 2,357,555 | 9/1944 | Seaton | 312/324 |
| 2,488,035 | 11/1949 | Pistone | 312/290 |
| 2,555,102 | 5/1951 | Anderson | 211/49 R |
| 2,620,063 | 12/1952 | Stanton | 211/49 R |
| 2,634,189 | 4/1953 | Hill | 312/250 |
| 2,961,846 | 11/1960 | Federico | 312/324 |
| 3,378,323 | 4/1968 | Goldberg | 312/290 |

*Primary Examiner*—Victor N. Sakran

*Attorney, Agent, or Firm*—Weiser, Stapler & Spivak

[57] ABSTRACT

The baseball equipment cabinet includes a wheeled enclosure suitable for transporting equipment to be used by a baseball team. The cabinet includes an enclosure which is defined generally by a closed back, sides and bottom and by openable front storage doors and by a top or upper hinged flap. The main compartment and front storage doors are further defined to provide specific area for storage of baseball bats, catcher's equipment, baseballs, printed materials and accessory equipment. The cabinet includes a pair of wheels and handle and accessory hinges as may be required to facilitate the movement of the cabinet when closed and to permit easy access to the stored materials when the cabinet is opened.

6 Claims, 3 Drawing Figures

BASEBALL EQUIPMENT CABINET

BACKGROUND OF THE INVENTION

The invention relates generally to equipment carrying enclosures, and more particularly, is directed to a compact baseball caddy that is readily movable when in the closed position and which permits easy access to the interior contents when in the open position.

Many team sports, such as baseball, require a considerable amount of accessory equipment in order to play the game and to provide necessary safety for the players participating in the sport. Most frequently, it has been the practice to simply carry the necessary ancillary equipment to the playing area and no particular attempt has been made to provide a convenient, specially designed, compact storage container suitable to transport the accessory equipment and supplies to the area where the game is to be played. Because of this lack of a suitable carrying device, it was frequently necessary for the players themselves to carry whatever equipment they thought might be necessary or utilized during the course of the game.

Of course, without any particular storage facility and without any central control, frequently necessary or desirable portions of the equipment and safety devices were simply forgotten or perhaps became lost during transportation to the playing field. Additionally, after the game itself, without any central collecting point or any particular storage compartment or method of transportation, some of the equipment might easily become lost or forgotten. Because of this, the need has long existed to provide an easily transportable, specially designed, equipment storage and transportation cabinet to thereby allow a single individual to be responsible both for securing the necessary equipment and supplies, transporting the equipment to the playing field and then to removing all equipment and supplies from the playing field once the game has been completed.

SUMMARY OF THE INVENTION

The present invention relates generally to a baseball caddy or equipment storage cabinet comprising essentially a wheeled main compartment including a handle attached exteriorly to the compartment, a pair of storage type front doors hingedly connected to the main compartment and including specially designed, additional storage areas and a hinged top to facilitate easy access to the compartment interior. The entire cabinet is designed to store in particular places the specialized equipment pertaining to the game, for example baseball equipment, wherein the entire storage compartment, when loaded can be readily moved or transported to the playing field or other location of use by a single individual.

The main compartment of the cabinet of the present invention comprises generally an enclosure including a fixed back, fixed side and bottom panels and openable front storage type doors hingedly connected to the side panels. A hinged top is openable above the side panels and may be equipped with a suitable latch to secure both the top and the front doors in the closed position during transportation. In the embodiment illustrated, the main compartment includes a plurality of horizontal shelves to store small items of equipment, for example baseballs, printed rule books, scorebooks and the like, first aid kit and towels. Additionally, the main compartment includes a base storage area for bulky equipment such as the catcher's equipment, and a vertical storage compartment for conveniently storing a plurality of batting helmets. Preferably, the doors hingedly open from the main compartment and include racks to vertically support and store a plurality of baseball bats in a convenient manner. If desired, a hinged door can be placed in front of the catcher's equipment storage area to readily retain the material in position. Also, in the preferred embodiment, the underside of the hinged top is equipped with lined blocks suitable for insertion of the players' names to thereby serve as a lineup board.

A pair of large wheels and a handle are exteriorly affixed to the cabinet to facilitate easy transportation of the device to the playing field by a single individual. Preferably, the cabinet including the front doors and hinged top are closed and locked during transportation. Once the device is rolled to the playing field, then all of the movable members are openable about hinges to allow ready access to the interior of the cabinet and to provide an easily accessible storage area for use by the players during the progress of the game. Accordingly, a player may approach the cabinet to pick a particular bat or batting helmet when his batting turn approaches and can similarly replace the bat and batting helmet after his turn at bat has been completed.

It is therefore an object of the present invention to provide an improved baseball equipment cabinet of the type set forth.

It is another object of the present invention to provide a novel baseball equipment cabinet including a wheeled main compartment and a plurality of specially configured storage areas provided in the main compartment.

It is another object of the present invention to provide a novel baseball equipment cabinet including a main compartment, the compartment being defined by fixed rear and side walls and further including hingedly connected storage doors, which doors are openable to provide easy access to the main compartment interior.

It is another object of the present invention to provide a novel baseball equipment cabinet including a main compartment including a pair of wheels and a handle for transportation purposes, a pair of right and left storage doors which are hingedly movable between a closed position to close the front of the cabinet to open positions to expose the interior contents of the cabinet, and a hinged top which can close the top of the cabinet during transportation and which is hingedly movable to an open position once the cabinet is moved to the playing field.

It is another object of the present invention to provide an improved baseball equipment cabinet that is simple in design, inexpensive in manufacture and trouble free when in use.

Other objects and a fuller understanding of the invention will be had by referring to the following description and claims of a preferred embodiment, taken in conjunction with the accompanying drawings wherein like reference characters refer to similar parts throughout the several views and in which:

DESCRIPTION OF THE PREFERRED EMBODIMENT OF THE INVENTION

Figure 1:
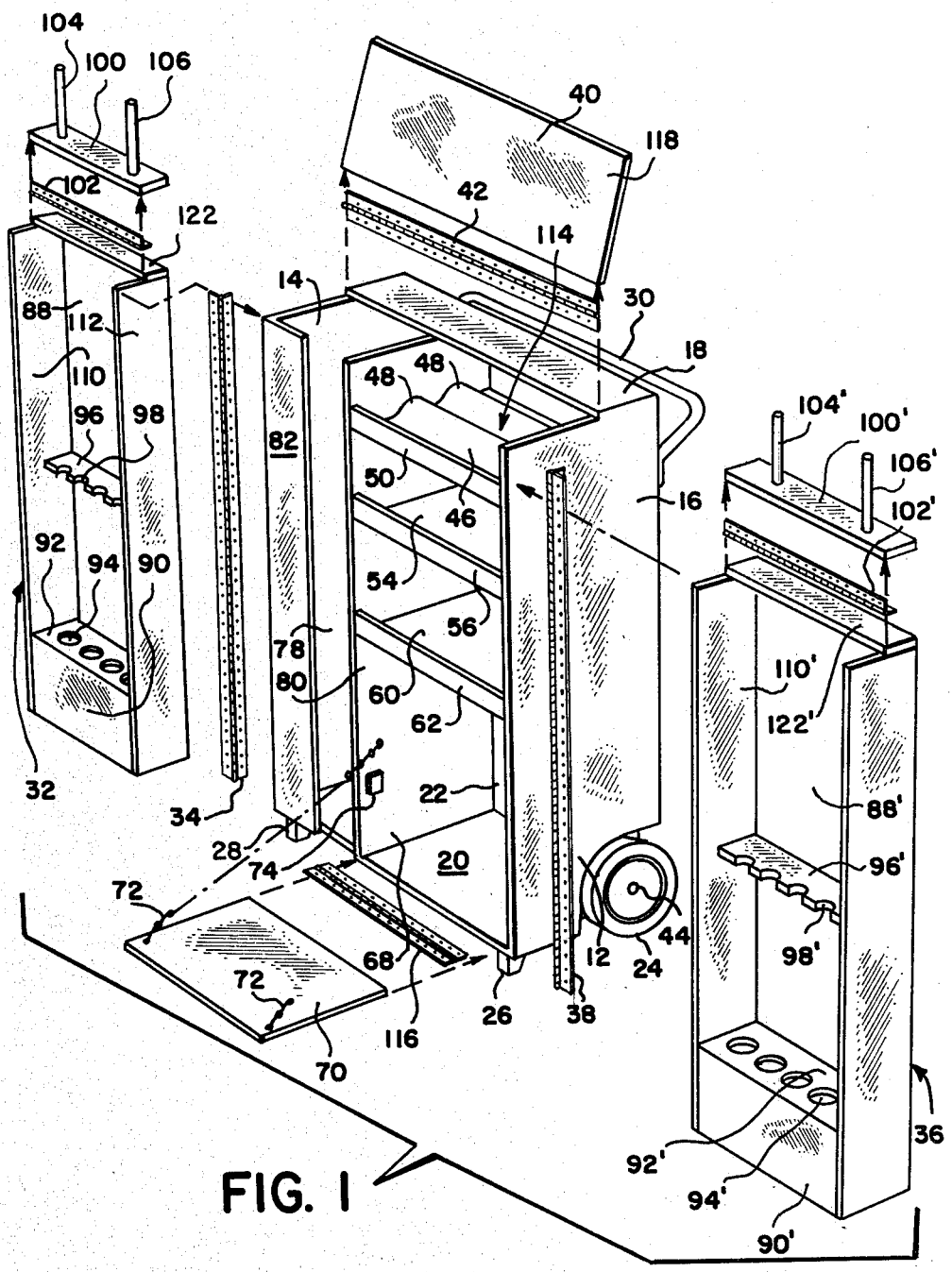
FIG. 1 is an exploded, perspective view of the invention showing the relationship of various parts when the cabinet is in use.

Although specific terms are used in the following description for the sake of clarity, these terms are intended to refer only to the particular structure of the invention selected for illustration in the drawings, and are not intended to define or limit the scope of the invention.

Figures 2, 3:
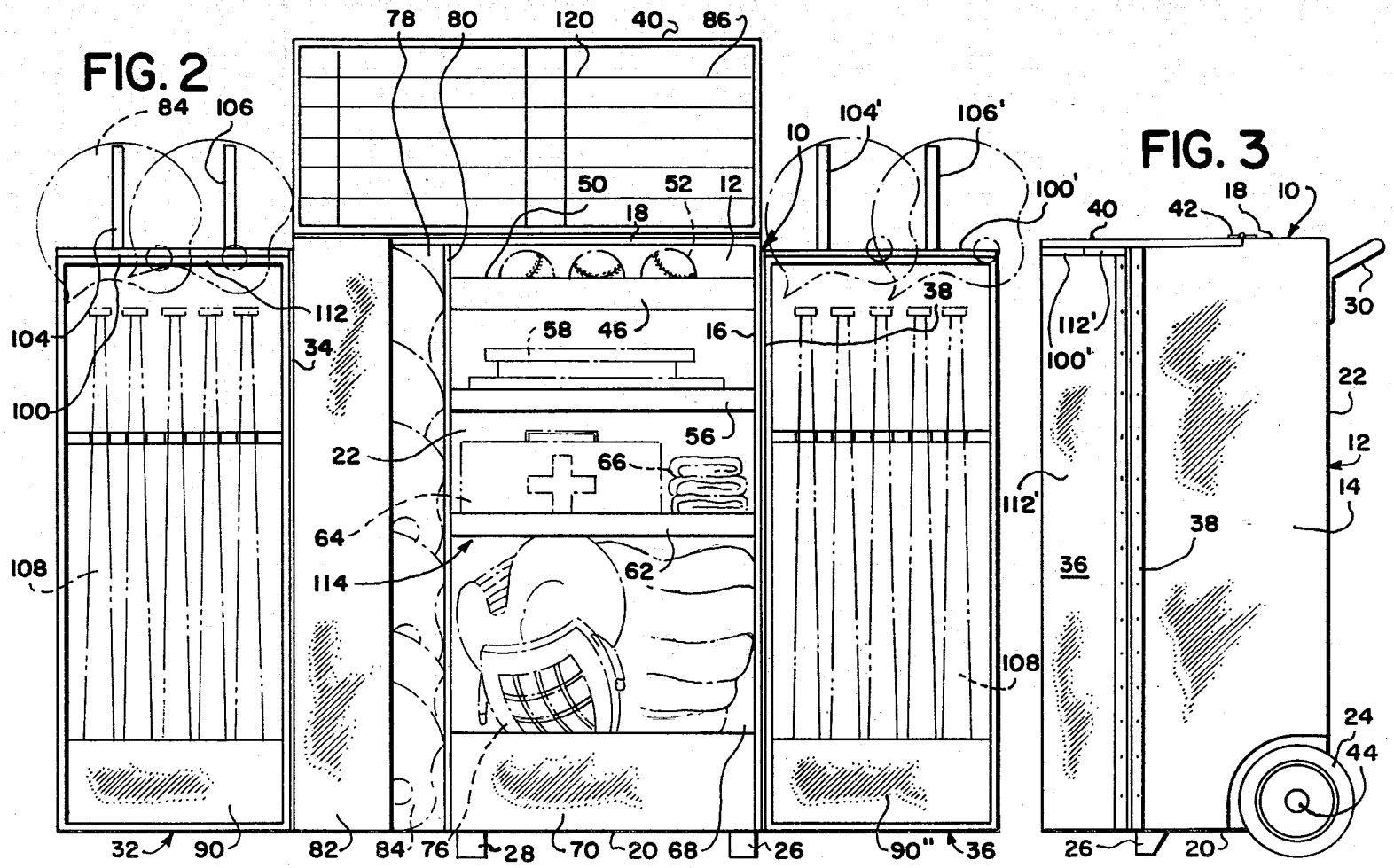
FIG. 2 is a front elevational view showing the doors and top in open position.
FIG. 3 is a side elevational view of the cabinet of FIG. 2, showing the doors and top in closed position.

Referring now to the drawings, there is illustrated a portable cabinet 10 which may be readily moved from place to place in conventional manner by a single operator. As best seen in FIGS. 1 and 3, the cabinet 10 comprises a pair of wheels 24 which are rotatable about the cabinet connected axle 44 in the usual manner. A handle 30 affixes to the back of the main compartment at the rear panel 22 and extends rearwardly in usual manner to provide proper leverage to enable the operator (not shown) to move the cabinet 10 by either pushing or pulling the to roll the wheels 24 over the ground. It is contemplated that the cabinet 10 will be tilted rearwardly when being moved and once the proper location is reached, the cabinet will be permitted to rotate forwardly about the axle 44 until the front blocks 26, 28 engage the ground to thereby stabilize the cabinet when the device is in use at the playing field.

Referring now to FIGS. 1 and 2, the cabinet comprises a main compartment 12 which is generally defined between a left side panel 14, a right side panel 16, and a top 18 and bottom 20 which are rigidly connected to the left and right side panels 14, 16. The main compartment 12 is subdivided horizontally by the vertical divider 80 into a helmet storage area or compartment 78 and a general storage area or compartment 114.

The helmet storage compartment 78 is laterally defined between the left side panel 14 and the vertical divider 80, is transversely defined between the main compartment rear wall 22 and the vertical front panel 82 and is horizontally defined between compartment top panel 18 and the main compartment bottom panel 20. As illustrated, the vertical front panel 82 is less in width than the helmet compartment 78 to thereby provide a convenient vertical space through which the batting helmets 84 are clearly visible and can be easily grasped. It is noteworthy that the space between the right edge of the vertical front panel 82 and the vertical divider 80 is less in width than the dimensions of a batting helmet 84 whereby the helmets can be removed only by lifting vertically through the top opening and cannot be removed simply by pulling a helmet forwardly.

The general storage area 114 of the main compartment 12 is horizontally subdivided into a number of convenient storage areas to provide maximum utilization of storage space and to insure maximum convenience and ready access to the stored equipment and materials. As illustrated, the top shelf 46 extends horizontally between the vertical divider 80 and the right panel or side 16 and includes a pair of horizontally oriented, raised ball retainers 48 and a forward lip or ledge 50. In this manner, a plurality of baseballs 52 can be conveniently stored for easy access with full visibility and maximum storage space. Immediately below the top shelf 46 is positioned a middle shelf 54 which also extends between the divider 80 and right side panel 16. The middle shelf 54 terminates forwardly in a front ledge or retainer 56 to conveniently retain the stored materials, such as printed rulebooks 58, scorecards, and the like.

Immediately below the middle shelf 54 is positioned the lower shelf 60 which similarly extends between and is connected to the vertical compartment panel 80 and the right side panel 16. The lower shelf 60 terminates forwardly in a retainer ledge 62 to keep stored materials, such as a first aid kit 64, towels 66 or other materials to be stored in position, both when being transported and when the cabinet is open. A large lower storage area 68 is defined between the lower shelf 60 and the main compartment bottom panel 20 and between the vertical divider 80 and the right compartment side panel 16 to contain large items of playing equipment, such as the catcher's equipment 76 which can contain such items as a face mask, chest protector, knee pads, glove and similar equipment.

A hinged door 70 bottomly connects to the main compartment bottom panel 20 to partially enclose the front of the general storage area 114 as illustrated in FIG. 2. When desired, the door 70 may be opened about the piano hinge 116 to the horizontal position illustrated in FIG. 1. If desired, a chain 72 may be interconnected between the top of the door 70 and the interior of the storage area 114 to provide a horizontally aligned platform when the device is in use. An interior block or stop 74 is affixed against the vertical divider 80 inwardly from the forward edge to provide a convenient stop for the door 70 when the door is rotated about the piano hinge 116 to the closed position illustrated in FIG. 2. If desired, the block or stop 74 can be provided with a catch, such as a magnetic catch (not illustrated) in known manner to releasably retain the door 70 in the vertical position of FIG. 2.

The top of the main compartment 12 is partially openable by providing a hinged top 40 which is rotatable about the piano hinge 42. As best seen in FIGS. 1 and 3, the piano hinge 42 is interconnected between one edge of the top panel 40 and the stationary main compartment top panel 18. Preferably, the interior surface 118 is provided with a plurality of vertical and horizontal lines 120 which define a lineup board 86 wherein indicia such as the players' names, positions, batting averages, etc. may be removably placed. It is contemplated that the interior surface 118 could be covered with a material suitable for writing purposes, such as a blackboard or slateboard and the indicia could be removably written by an eraseable material, such as chalk.

Referring now to the FIGS. 1 and 2, it will be seen that the front of the main compartment 12 is closed by a pair of horizontally openable left and right storage doors 32, 36. The left and right doors 32, 36 are fabricated of similar design and are rotatable about the main compartment 12 upon respective left and right piano hinges 34, 38. Each door includes a bat storage compartment or storage area 88, 88' defined between left and right sides 110, 110', 112, 112', an interconnecting top panel 122, 122', and a bottom front panel 90, 90'. The front panel 90, 90' terminates upwardly in a horizontal bat holder 92, 92' which is provided with a plurality of bat openings 94, 94' of suitable size to receive the large end of a baseball bat therewithin. Within the interior of each bat storage area 88, 88' is provided a horizontal, medially positioned alignment strip 96, 96' which includes a plurality of semicircular openings 98, 98' in generally vertical alignment over each bat receiving opening 94, 94'. As illustrated, the upper limit of each door 32,36 is further defined by a hinged top panel 100, 100' which is positioned forwardly of and in generally planar arrangement with the door top panel 122, 122'. A hinge 102, 102' permits hinged movement of the top panel 100, 100' relative to its connected door top panel 122, 122'. Each hinged top panel 100, 100' is provided with at least a pair of spaced helmet dowels or pegs 104, 104' and 106, 106' for helmet placement when the device is in use. See FIG. 2. Accordingly, when each hinged top panel 100, 100' is rotated about its respective hinge 102, 102', the helmet pegs 104, 104', 106, 106' will be vertically positioned to thereby easily hold a batting helmet 84 in readily accessible location for easy grasping by a player (not shown).

As can be seen, the cabinet 10 provides a specially designed vehicle to permit convenient storage and transportation of substantially all of the equipment to be used by a baseball team. The cabinet can be employed with equal facility by both hardball teams and softball teams. In the locker room or headquarters area, all of the equipment to be used in a game can be loaded into the cabinet 10 in substantially the manner illustrated in FIG. 2. With all of the equipment, such as baseballs 52, rulebooks and other printed materials 58, first aid kit 64, towels 66, catcher's equipment 76, batting helmets 84 and bats 108 positioned substantially as illustrated in FIG. 2, the various component parts can be closed about the various vertical and horizontal hinges 34, 38, 42, 102, 102' and 116 to the closed condition illustrated in FIG. 3. A catch (not illustrated) if employed can then be secured to maintain the left and right front storage doors 32, 36 and the top hinged panel 40 in closed position. The cabinet 10 can then be transported to the desired location of use by rolling the device by utilizing the handle 30 and the wheels 24. Once the portable cabinet 10 has been properly positioned, the main compartment 12 can be rotated to the vertical position wherein it is maintained in stable, horizontal location by the wheels 24 and the front blocks 26, 28. The front doors 32, 36 can then be opened, and the top panel 40 and the bottom storage door 70 can be opened about their respective hinges to provide easy access to the cabinet interior compartment. Similarly, the door top panels 100, 100' can be rotated to position the helmet pegs or dowels 104, 104', 106, 106' in vertical orientation. In this manner, the entire cabinet 10 will assume the open position as illustrated in FIG. 2 to provide ready access to all of the stored equipment for use by the team during the course of the game.

Although the invention has been described with a certain degree of particularity, it is understood that the present disclosure has been made only by way of example and that numerous changes in the details of construction and the combination and arrangement of parts may be resorted to without departing from the scope of the invention.

What is claimed is:

1. In an equipment cabinet, the combination of a main compartment defined laterally between a left side panel and a right side panel, transversely between a rear wall and front vertical panel and vertically between a top panel and a bottom panel, the left and right side panels and the bottom panel extending transversely the entire depth of the cabinet, the top panel being interconnected between the left and right side panels and being rigidly connected to the tops of the left and right side panels and the rear wall, the top panel extending forwardly from the rear wall a transverse distance that is less than the depth of the cabinet to define a top opening;

the front vertical panel being connected to a side panel and extending laterally toward the other side panel a distance that is less than the lateral distance between the left and right side panels to define a front opening;

a vertical divider of height and depth equal to the side panels and positioned parallel to and intermediate the left and right side panels, the divider subdividing the main compartment into a helmet compartment and a main storage area, the said front opening exposing the entire front of the main storage area and only a portion of the front of the helmet compartment, a left storage door hingedly connected to the left side panel and covering a portion of the said front opening; and a right storage door hingedly connected to the right side panel and covering the remainder of the said front opening.

2. The equipment cabinet of claim 1 wherein the left and right storage doors are movable about the respective hinged connections between closed positions wherein the doors enclose the front of the cabinet completely from the left side panel to the right side panel and open positions wherein the doors swing respectively about the left and right side panel hinged connections and expose both the said front vertical panel, a portion of the helmet compartment and the entire front of the main storage area.

3. The equipment cabinet of claim 1 wherein at least one of the doors includes an interior storage space of sufficient depth to store a three dimensional article therewithin, the interior storage space being upwardly defined by a top panel, the top panel comprising a fixed top panel and a hingedly connected, movable top panel, the movable top panel being movable about the hinged connection from a horizontal, closed position to a horizontal open position.

4. The equipment cabinet of claim 6 wherein the movable top panel includes at least one peg projecting therefrom, the peg projecting downwardly interiorly of the storage door when the movable top panel is in the closed position, the said peg projecting vertically upwardly and exteriorly of the storage space when the movable top panel is in the said open position.

5. The equipment cabinet of claim 1 and a movable, hinged top connected to said top panel, the hinged top being movable from an initial position in substantially planar alignment with the said top panel to a final position in angular alignment with the said top panel, the hinged top, when in the final position comprising a flat, vertical surface, the surface being provided with a plurality of permanent markings thereon, the surface being suitable to removably receive written indicia thereon.

6. The equipment cabinet of claim 1 and a hinged door connected to the bottom panel in front of the main storage area, the hinged door being movable between an initial, vertical position wherein the door covers only a portion of the said front opening in front of the main storage area to a final, horizontal position in front of the main storage area wherein the said portion of the front opening is not covered.

* * * * *